US007722806B1

(12) United States Patent
Weinstein

(10) Patent No.: US 7,722,806 B1
(45) Date of Patent: May 25, 2010

(54) PALLADIUM SOLDER

(76) Inventor: Keith Weinstein, 4316 Marina City Dr., #519, Marina Del Rey, CA (US) 90292

( * ) Notice: Subject to any disclaimer, the term of this patent is extended or adjusted under 35 U.S.C. 154(b) by 325 days.

(21) Appl. No.: 11/786,773

(22) Filed: Apr. 11, 2007

(51) Int. Cl.
*C22C 5/04* (2006.01)

(52) U.S. Cl. ..... 420/463; 148/678; 148/430

(58) Field of Classification Search ..... 420/463; 148/678, 430; 219/146.1
See application file for complete search history.

(56) References Cited

U.S. PATENT DOCUMENTS 5,240,172 A 8/1993 Steinke et al.
5,298,218 A * 3/1994 Groll et al. ..... 420/463

FOREIGN PATENT DOCUMENTS

JP 02-93033 * 4/1990
JP 62-56544 * 3/1997

* cited by examiner

*Primary Examiner*—Deborah Yee
(74) *Attorney, Agent, or Firm*—The Law Office of Jane K. Babin, Professional Corporation; Jane K. Babin

(57) ABSTRACT

Gold solder compositions for assembling, repairing and sizing jewelry containing about 85% to 95% by weight palladium and an alloy mixture containing about 5% to 15% gallium and indium, in a weight ratio of approximately 7:3. The invention also provides a solder composition for assembling, repairing and sizing jewelry containing white gold and palladium, but not containing nickel. Such a solder contains gold, silver, copper, zinc, palladium, gallium and indium, whereby the gallium and indium is in a weight ratio of 6:4, 7:3 or 8:2, respectively.

5 Claims, No Drawings

PALLADIUM SOLDER

FIELD OF THE INVENTION

The present invention relates to a solder composition and, more particularly, to a solder composition for assembling, repairing and/or sizing jewelry containing about palladium or gold and palladium, and a mixture containing silver, copper, zinc, gallium and indium.

BACKGROUND INFORMATION

A variety of solder compositions are known in the art for repairing palladium jewelry. These prior art compositions arc characterized by melting temperatures and as high as about 1700° C. The higher melting temperatures are difficult to work with.

SUMMARY OF THE INVENTION

The present invention is solder compositions for palladium and white-gold with palladium containing jewelry.

In one embodiment of the invention there is provided a composition for soldering jewelry containing about 85% to 95% by weight palladium, and a mixture containing of about 5% to 15% by weight gallium and indium in a respective weight ratio of about 7:3.

In another embodiment of the invention, there is provided a composition for soldering jewelry containing about 58.33% by weight gold, and the remaining mixture containing silver, copper, palladium, gallium or indium, or a combination thereof, whereby the gallium and indium is in a respective weight ratio of 6:4, 7:3 or 8:2.

Still, in one embodiment of the invention, there is provide a composition for soldering jewelry containing about 75% by weight gold, and the remaining mixture containing silver, copper, zinc, palladium, gallium or indium, or a combination thereof, whereby the gallium and indium is in a respective weight ratio of 6:4, 7:3 or 8:2.

DETAILED DESCRIPTION OF THE INVENTION

The present invention may be understood more readily by reference to the following detailed description of specific embodiments and the Examples included therein.

The present invention provides a solder that is easy and safe to use because it has a relatively low flow temperature of about 1200° C. to 1250° C. A particularly preferred solder of the present invention consists essentially of about 85% to 95% by weight Pd, and a mixture of gallium and indium in a respective weight ratio of approximately 7:3, or 70% by weight gallium and 30% by weight indium.

In another embodiment of the invention, there is provided another solder composition useful for soldering, assembling, repairing, or sizing of jewelry containing white gold, e.g., about 25% (6 karat), 41.66% (10 karat), 58.33% (14 karat), 75% (18 karat) and 91.66% (22 karat) by weight gold. Such white gold jewelry will also contain a balance of other metals including palladium, with the proviso that the gold jewelry does not contain nickel. The solder composition contains the karated amount of gold, and a mixture of silver, copper, zinc, palladium, gallium and indium, whereby the gallium and indium is in a respective weight ratio of 6:4, 7:3 or 8:2.

The solders of the present invention are prepared by melting the Pd and alloy mixture together in specified amounts by any conventional method, e.g., by the known hot torch or electric methods, followed by quenching, rolling and annealing to provide softness to the solder. A hot torch method is preferred. The solder can be manufactured and provided for use in any known form. Such forms include, for example, flat sheets of about 0.2 mm thickness and predetermined weight and dimension, 1 mm diameter round wire, or a paste solder.

Methods of forming a solder are well known in the art. For example, after combining or melting the various metals, the metal mixture or solder is allowed to cool before it is cast with hydrogen and oxygen in a steel upright ingot mold for forming a solder bar. The solder bar is then allowed to cool to about room temperature. The solder bar is then cleaned by grinding the edges and rolled to a desired thickness. An additional step of annealing is optional depending on desired softness. This rolling, annealing and quenching cycle of steps is repeated numerous times to incrementally reduce the solder bar to a desired thickness. Subsequent to each successive cycle the annealing temperature is reduced. The solder is then finished in a conventional manner and individually hand-stamped for identification.

The soldering step can occur during the assembly, repair and/or sizing of a piece gold content jewelry. A piece of the solder (e.g., 0.2 mm thickness) is cut to a desired size (e.g., 1 mm×1 mm), placed with tongs at the desired location on the gold jewelry, and then melted with a hot torch, whereupon the solder flows into the desired area on the jewelry. Upon removal of the hot torch, the solder rapidly cools, hardens and solidifies.

The potential applications of the methods described herein are many. Thus, for example, a ring from inventory can be adjusted by sizing to a larger or smaller size to fit the finger of a given customer. The solder used to adjust the ring size will match perfectly in color with the color of the original ring. No scams or dark spots are observed at the interface between the solder and the ring. As another example, the solder can be used in jewelry repair jobs, e.g., when replacing a damaged or broken gold prong on a diamond ring (known as retipping). The solder used in the retipping procedure will match perfectly in color with the color of the ring itself and no dark spots or scams are observed at the solder-jewelry interface. As a final example, the solder can be used in a desired manner during the original assembly of gold content jewelry items. The solder matches perfectly in color with the color of the gold jewelry. No color differences result.

The following Examples illustrate preferred embodiments of the solder compositions of the present invention, and the method of making and using such solder compositions.

Example 1

A solder composition is provided herein for use with gold containing jewelry, e.g., about 25% (6 karat), 41.66% (10 karat), 58.33% (14 karat), 75% (18 karat) and 91.66% (22 karats) white gold. In particular, the solder composition described herein is useful for soldering, assembling, repairing and/or sizing 14K and 18K white gold made with palladium, with the proviso that the white gold/palladium jewelry does not contain nickel. A 14K (e.g., 14 KPDXE and 14 KPDH) or an 18K (e.g., 18 KPDH and 18 KPDH) gold-palladium jewelry, for example, contains about 58.33% or 75% pure gold (or 24K gold), and further containing at least palladium, but does not contain nickel.

A solder for use with a plumb 14K or 18K gold-palladium jewelry (nickel-free), contains about 58.33% (14K) gold (Au) and the remaining balance selected from a metals including silver, copper, zinc, palladium, gallium and indium. For example, a plumb 14K pr 18K white gold, or 14 KPDXE and 18 KPDXE, contains about 58.33% or 75% Au, about 3 to 15% silver (Ag), about 1-3% copper (Cu) or zinc (Zn) and about 10-21% palladium (Pd), and the remaining balance a mixture of gallium (Ga) and indium (In) in a 6:4, 7:3 or 8:2 by weight ratio, respectively.

The following table describes solder compositions for plumb and hard 14 and 18 karat white gold containing palladium but not nickel.

TABLE I

Solders for plumb and hard 14 and 18K white gold

| 14K-PD*-XE** | 18K-PD-XE | 14K-PD-H*** | 18K-PD-H*** |
|---|---|---|---|
| 58.33 Au | 75 Au | 58.33 Au | 75 Au |
| 14.46 Ag | 3.5 Ag | 14.4 Ag | 4.9 Ag |
| 1 Cu | 2 Zn | 2 Cu | 2.5 Cu |
| 20.14 Pd | 12.5 Pd | 20.14 Pd | 12.6 Pd |
| 6.07 Ga:In | 7 Ga:In | 5.09 Ga:In | 5 Ga:In |

*PD = palladium (Pd);
**XE = extra easy or extra plumb;
***H = hard

For example, solder useful for a plumb 14K white gold-palladium jewelry or 14 KPDXE, contains about 58.33% gold (Au), about 14.46% silver (Ag), about 1% copper (Cu), about 20.14% palladium (Pd), the remaining balance, about 6.07%, a mixture of gallium and indium in a 6:4 by weight ratio (e.g., 3.64 Ga and 2.43 In); or a 7:3 by weight ratio (e.g. 4.25 Ga and 1.82 In); or an 8:2 by weight ratio (e.g., 4.86 Ga and 1.21 In).

A solder useful for a plumb 18K white gold-palladium jewelry or 18 KPDXE, contains about 75% Au, about 3.5% Ag, about 2% zinc (Zn), about 12.5% Pd, the remaining balance, about 7%, a mixture of gallium and indium in a 6:4 by weight ratio (e.g., 4.2 Ga and 2.8 In); or a 7:3 by weight ratio (e.g. 4.9 Ga and 2.1 In); or an 8:2 by weight ratio (e.g., 5.6 Ga and 1.4 In).

A solder useful for a hard 14K white gold-palladium jewelry or 14 KPDH, contains about 58.33% gold (Au), about 14.4% silver (Ag), about 2% copper (Cu), about 20.14% palladium (Pd), the remaining balance, about 5.09%, a mixture of gallium and indium in a 6:4 by weight ratio (e.g., 3.05 Ga and 2.04 In); or a 7:3 by weight ratio (e.g. 3.56 Ga and 1.53 In); or an 8:2 by weight ratio (e.g., 4.07 Ga and 1.02 In).

A solder useful for a hard 18K white gold-palladium jewelry or 18 KPDH, contains about 75% Au, about 4.9% Ag, about 2.5% Cu, about 12.6% Pd, the remaining balance, about 5%, a mixture of gallium and indium in a 6:4 by weight ratio (e.g., 3 Ga and 2 In); or a 7:3 by weight ratio (e.g. 3.5 Ga and 1.5 In); or an 8:2 by weight ratio (e.g., 4 Ga and 1 In).

The solder compositions for use with the white gold-palladium and nickel-free solders have low melting temperature from about 900° C. to about 1100° C.

Example 2

In another embodiment, a solder composition is provided herein whereby the solder is useful for soldering, assembling, repairing and/or sizing about 85% to 95% Pd containing jewelry. Such a solder can be used with a plumb, hard or extra plumb (or extra easy, XE) Pd jewelry. Table II describes hard, easy and extra easy Pd solders.

TABLE II

Solders for 95% palladium (Pd) jewelry

| PD-H | PD-E* | PD-XE |
|---|---|---|
| 95 Pd<br>5 Ga:In | 90 Pd<br>10 Ga:In | 85 Pd<br>15 Ga:In |

*E = easy

Thus, a solder for use with a hard or about 95% containing Pd jewelry, contains 95% Pd and 5% gallium and indium in a weight ratio of 7:3, respectively (e.g., 3.5 Ga and 1.5 In). An solder for use with an easy or plumb 90% containing Pd jewelry contains about 90% Pd and 10% Ga:In in a weight ratio of 7:3, respectively (e.g., 7 Ga and 3 In). A solder for use with an extra easy or extra plumb 85% containing Pd jewelry contains about 85% Pd and 15% Ga:In in a weight ratio of 7:3, respectively (e.g., 10.5 Ga and 4.5 In).

The solder compositions for use with hard, easy and extra easy palladium solders have melting temperature from about 1200° C. to about 1300° C.

Although the present invention has been described with reference to specific details of certain embodiments thereof in the above examples, it will be understood that modifications and variations are encompassed within the spirit and scope of the invention. Accordingly, the invention is limited only by the following claims.

What is claimed is:

1. A composition for soldering jewelry consisting of 85% to 95% by weight palladium, and a mixture consisting of 5% to 15% by weight gallium and indium in a respective weight ratio of about 7:3.

2. The composition of claim 1, wherein the palladium is 85% by weight and the mixture is 15% by weight gallium and indium in a respective weight ratio of about 7:3.

3. The composition of claim 1, wherein the palladium is about 90% by weight and the mixture is about 10% by weight gallium and indium in a respective weight ratio of about 7:3.

4. The composition of claim 1, wherein the palladium is 95% by weight and the mixture is 5% by weight gallium and indium in a respective weight ratio of about 7:3.

5. The composition of claim 1, wherein the composition has a melting temperature from about 1200° C. to about 1300° C.

* * * * *